United States Patent [19]

Carr et al.

[11] Patent Number: 4,916,721

[45] Date of Patent: Apr. 10, 1990

[54] NORMAL INCIDENCE X-RAY MIRROR FOR CHEMICAL MICROANALYSIS

[75] Inventors: Martin J. Carr, Tijeras; Alton D. Romig, Jr., Albuquerque, both of N. Mex.

[73] Assignee: The United States of America as represented by the United States Department of Energy, Washington, D.C.

[21] Appl. No.: 81,964

[22] Filed: Aug. 5, 1987

[51] Int. Cl.[4] ..... G21K 1/06

[52] U.S. Cl. ..... 378/84; 378/49; 378/82

[58] Field of Search ..... 378/84, 82, 49

[56] References Cited

U.S. PATENT DOCUMENTS

| | | | |
|---|---|---|---|
| 4,238,529 | 12/1980 | Sicignano et al. | 378/84 |
| 4,261,771 | 4/1981 | Dingle et al. | 378/84 |
| 4,599,741 | 7/1986 | Wittry | 378/85 |
| 4,737,973 | 4/1988 | Ogawa et al. | 378/84 |

OTHER PUBLICATIONS

Underwood, James H., et al., "Layerd Synthetic Microstructures: Properties and Application in X-ray Astronomy" (1979).

Spiller, E., "Low-Loss Reflection Coatings Using Absorbing Materials", *Applied Physics Letters,* vol. 20, No. 9, 05/01/72, pp. 395-397.

From the Conference on "Low Energy X-Ray Diagnositcs-1981", 1981 American Institute of Physics, *AIP Conference Proceedings,* No. 75, vol. 0094-243X/81/750162-08:

Rehn, V., "Focussing, Filtering, and Scattering of Soft X-Rays by Mirrors":, pp. 162-169.

Underwood, J. and Barbee, Jr., T. W., "Synthetic Multilayers of Bragg Diffractors For X-Rays and Extreme Ultraviolet: Calculations of Performance", pp: 170-178.

Price, R., "X-Ray Microscopy Using Grazing Incidence Reflection Optics":, pp. 189-199.

Ceglio, N., "The Impact of Microfabrication Technology on X-Ray Optics", pp. 210-222.

Underwood, J. H. & Attwood, D., "the Renaissance of X-Ray Optics", *Physics Today,* Apr. 1984, pp. 44-52.

Fernandez, F., and Falco, C., "Sputter Deposited Multilayer V-UV Mirrors", *SPIE,* vol. 563-Applications of Thin ∝ Film Multilayered Structures to Figured X-Ray Optics (1985), pp. 195-200.

(List continued on next page.)

*Primary Examiner*—Carolyn E. Fields
*Assistant Examiner*—David P. Porte
*Attorney, Agent, or Firm*—Anne D. Daniel; James H. Chafin; William R. Moser

[57] ABSTRACT

A non-planar, focusing mirror, to be utilized in both electron column instruments and micro-x-ray fluorescence instruments for performing chemical microanalysis on a sample, comprises a concave, generally spherical base substrate and a predetermined number of alternating layers of high atomic number material and low atomic number material contiguously formed on the base substrate. The thickness of each layer is an integral multiple of the wavelength being reflected and may vary non-uniformly according to a predetermined design. The chemical analytical instruments in which the mirror is used also include a predetermined energy source for directing energy onto the sample and a detector for receiving and detecting the x-rays emitted from the sample; the non-planar mirror is located between the sample and detector and collects the x-rays emitted from the sample at a large solid angle and focuses the collected x-rays to the sample.

For electron column instruments, the wavelengths of interest lie above 1.5 nm, while for x-ray fluorescence instruments, the range of interest is below 0.2 nm. Also, x-ray fluorescence instruments include an additional non-planar focusing mirror, formed in the same manner as the previously described mirror and located between the energy source and the sample, to collect x-rays emitted from the source and direct them to the sample without loss of intensity.

19 Claims, 1 Drawing Sheet

OTHER PUBLICATIONS

Vidal B. and Vincent, P., "Metallic Multilayers for X-Rays Using Classical Thin-Film Theory", *Applied Optics,* vol. 23, No. 11, Jun. 1, 1984, pp. 1794–1801.

Dhez, P., "Progress in Multilayer Devices as X-Ray Optical Elements", *Journal of Microscopy, vol. 138, Pt. 3, Jun. 1985, pp. 267-277.*

Spiller, E., "Multilayer X-Ray Mirrors, A First Step Toward the Custom Design of New Material Properties", 1985 Materials Research Society Meeting, *Proceedings of the* 1985 *Materials Research Society,* Boston, Mass., Dec. 1985, pp. 1–15.

Roming, A., "On the Potential Applications of Artificially Structured Materials for X-Ray Microanalysis", *Microbeam Analysis*–1986, *Proceedings of the 21st Annual Conference of the Microbeam Analysis Society,* Albuquerque, NM, SAND 86–1032 C, pp. 293–298.

FIG. 1
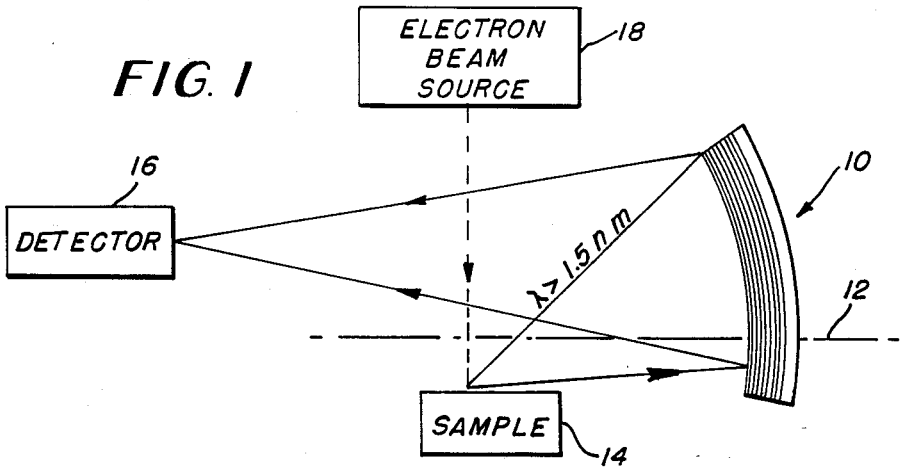
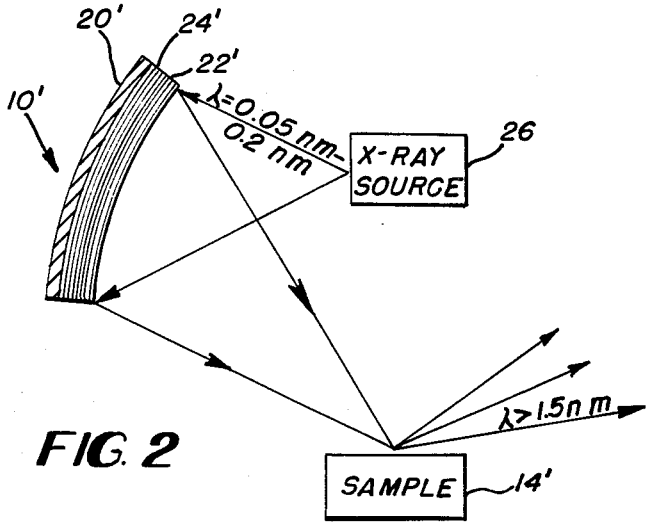
FIG. 2
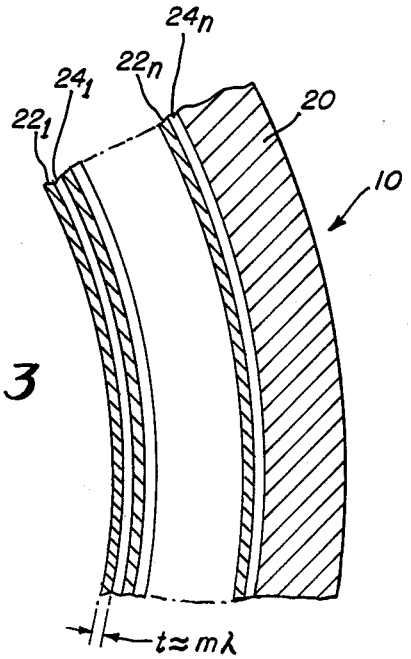
FIG. 3
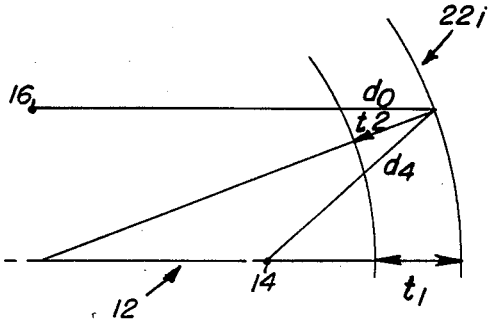
FIG. 4

NORMAL INCIDENCE X-RAY MIRROR FOR CHEMICAL MICROANALYSIS

The invention described herein was made in the performance of work under contract with the Department of Energy, Contract No. DE-AC04-76DP00789, and the United States Government has rights in the invention pursuant to this contract.

BACKGROUND OF THE INVENTION

The present invention relates to an improved focusing mirror for use in chemical analytical instruments, and, more particularly, to a non-planar focusing mirror. The present invention also relates to a chemical analytical instrument, utilizing a non-planar focusing mirror.

The standard method of focusing X-rays on a target is by collimation; however, this method is inherently inefficient. More recently, planar mirrors and toroidally shaped crystal structures have been developed to focus X-rays onto a sample. The latter type apparatus is disclosed, for example, in U.S. Pat. No. 4,599,741, entitled, "System For Local X-ray Excitation By Monochromatic X-rays", issued to David B. Wittry, on July 8, 1986, and is directed to the field of X-ray fluorescence analysis which is one method by which chemical microanalysis is currently being carried out.

Grazing (glancing) X-ray optics are used to reflect or focus X-rays in very large applications, but this technology cannot be scaled down to a size useful for chemical microanalysis.

Another technique utilized comprises the use of electron column instruments wherein a beam of high energy, greater than 10 keV(kiloelectron volts), electrons are focused onto a sample. Electrons interact with the sample at the point of beam impingement, causing the sample to become ionized and produce a number of measurable signals, including characteristics X-rays. The energy of the characteristic X-ray is directly related to the energy levels in the atoms, and since each atom or element of which the sample is constructed has a unique electron structure, each atom or element will emit a unique characteristic X-ray spectrum. Interpretation of the spectrum permits qualitative analysis of an unknown specimen and with proper correction procedures, the spectrum can be used to determine the composition of the specimen quantitatively.

The X-ray analysis of light elements, for example, boron(B), carbon(C), nitrogen(N) and oxygen(O) having characteristic X-ray wavelengths of 6.67 nm, 4.44 nm, 3.16 nm and 2.36 nm, respectively, has been limited by relatively low fluorescence yield in electron beam instruments such as scanning electron microscopes, electron microprobes and analytical electron microscopes. The efficiency of x-ray production is a function of the energy of incident electrons. The efficiency of x-ray detection is a function of the analytical chamber geometry, which can restrict the solid angle within which the signal is collected, and, additionally, a function of the number of incident electrons and of the x-ray absorption in the solid-state or proportional counter x-ray detectors typically used. The low fluorescence yield is a function of the physics of electron beam/solid interactions and cannot be changed. Although low atomic number elements are easily ionized by incident electrons, they are not efficient producers of characteristic X-rays. Recent improvements have been made for reducing X-ray absorption in the detector, using windowless and ultra thin window detectors so that many of the X-rays which do in fact enter the detector are counted.

A larger detector is not a practical solution to increasing the count of X-rays. The physics of X-ray detection limit the size of these detectors. In addition, the high cost of each detector precludes the use of multiple detectors.

A typical attempt to increase the solid angle of collection of the fluorescent X-rays is to position the detector close to the point of X-ray generation. An increased benefit could be obtained if a mirror could be used to collect a weak signal from a large solid angle and focus it onto the detector. The same concept could be used to collect X-rays from higher atomic numbers which exhibit shorter characteristic X-ray wavelengths; however, poor counting statistics are usually a more severe problem for light elements.

X-ray mirrors have recently been developed and comprise planar mirrors produced by depositing alternating layers of high atomic number, for example, tungsten(W), and low atomic number, for example, carbon(C), materials on a planar substrate or other means of support.

In such a structure, the inner faces are very smooth and the interface spacings are an integral multiple of the reflected X-ray wavelength. A small percentage of the incident radiation will be reflected at each interface and since the spacing is a multiple of the integral wavelength, the reflected radiation will constructively interfere, giving rise to large total reflectivities. The efficiency of reflection is a function of the materials used to build the multilayers and of the multilayer spacing.

Such mirrors must have a sufficient number of layers to reflect a sufficient fraction of the incident X-rays, but not more layers than the number needed for total reflection, as limited by absorption of X-rays in the mirror. Calculation of these numbers of layers is known in the art.

For obtaining optimal efficiency, a separate mirror would be required for each specific wavelength of interest, although a mirror optimized for a given wavelength may reflect X-rays of differing wavelengths with suitable efficiency.

SUMMARY OF THE INVENTION

Accordingly, it is the primary object of the present invention to provide an improved means for focusing low energy X-rays.

Yet another object of the invention is to try to provide an improvement in X-ray type analytical instruments by increasing the solid angle of X-ray collection.

It is a further object of the invention to provide an improved means for focusing X-rays for chemical microanalysis.

It is another object of the invention to provide an improved means for focusing X-rays for light element analysis in electron column instruments.

It is still another object of the invention to provide an improved means for focusing X-rays for micro-X-Ray fluorescence instruments.

To achieve the foregoing and other objects, and in accordance with the purpose of the present invention, a novel, non-planar mirror structure for collecting and focusing x-rays, and a novel chemical analytical instrument, using the novel mirror structure, are provided. The concave mirror includes a base support formed with multiple alternating layers of high atomic number materials and low atomic number materials, respectively. The thickness of the respective layers are integral multiples of the wavelength of the x-rays being focused and may vary non-uniformly in a predetermined manner to compensate for the different paths taken by x-rays through the curved layers. The mirror structure may be spherical, cylindrical, parabolic, hyperbolic, ellipsoidal or other types of non-planar geometric shapes.

According to another aspect of the invention, a chemical analytical instrument for analysis of a sample is provided, which includes an energy source, a detector, and the novel mirror of the invention, positioned between the sample being tested and the detector. In this instrument, energy is directed to a sample which ionizes and produces a spectrum of characteristic x-rays, and the non-planar mirror collects and focuses the x-rays from a wide solid angle of the sample emission to the detector.

The instrument of the invention may be an electron column instrument or a micro-x-ray fluorescence instrument. In electron beam instruments, only one non-planar focusing and collecting mirror interposed between the sample and detector is required. A micro-x-ray fluorescence instrument may also use an additional mirror of the type provided by this invention, to collect and focus the x-rays from their source to the sample, also at a large solid angle of collection, in order to provide focusing of the x-rays at their full incident intensity. In micro-x-ray fluorescence instruments, relatively short wavelength x-rays from an x-ray source are collected and focused, by the second non-planar mirror interposed between the energy source and the sample, on the sample which fluroesces and emits a spectrum of characteristic x-rays.

For electron column instruments, the spectrum above 1.5nm, and more particularly, between 1.83nm and 6.7nm, referring to the spectrum of emission from the sample, comprises the spectrum of utilization, and dictates the parameters for the layer thicknesses of the focusing mirror to be utilized. For micro-x-ray fluorescence apparatus, x-rays in the range of 0.05nm to 0.2nm are emitted from the energy source and dictate the parameters for the layer thicknesses of the second mirror.

BRIEF DESCRIPTION OF THE DRAWINGS

The object of the present invention and the attendant advantages thereof will become readily apparent by reference to the following drawings wherein like numerals refer to like parts, and wherein:

FIG. 1 is a schematic diagram of the invention used in connection with electron column instruments for making chemical analysis;

FIG. 2 is a schematic diagram of the invention utilized in connection with micro-X-ray fluorescence instruments for making chemical analysis;

FIG. 3 is a partial cross sectional view illustrative of the preferred embodiment of an X-ray mirror in accordance with the invention; and FIG. 4 is a schematic view of a single layer showing the reflection of an X-ray.

DETAILED DESCRIPTION OF THE INVENTION

Referring now to the drawings and more particularly to FIG. 1, reference numeral 10 denotes a non-planar X-ray mirror for chemical microanalysis, and comprises in its simplest embodiment a segment of a sphere having an optical axis 12 utilized in combination with an off axis object and image point. The object point comprises a chemical sample 14 under test while the image point comprises an X-ray detector 16.

In the illustration of FIG. 1, electromagnetic energy, typically a 10 keV electron beam from a source 18 is directed to the sample 14 which ionizes, causing characteristic X-rays to be generated and emitted therefrom in a well known manner. For light elements, the X-rays generated thereby have wavelengths greater than 1.5 nm. For such elements as boron(B), carbon(C), nitrogen(N), oxygen(O) and fluorine(F), the characteristic wavelengths comprise 6.67 nm, 4.44 nm, 3.16 nm, 2.37 nm and 1.83 nm, respectively. As shown in FIG. 1, the X-rays emitted from the sample 14 are collected by the spherical mirror 10 and focused on the detector 16 which is located a distance away from the mirror corresponding to the mirror's focal length. The details of the spherical X-ray mirror 10 shown in FIG. 1 are disclosed in FIG. 3.

Referring now briefly to FIG. 3, the non-planar X-ray mirror according to the subject invention is comprised of a curved support member 20; for example, a spherical substrate having a radius of curvature of 66.0 cm would form a mirror to be utilized in an electron column instrument for chemical microanalysis. On the concave surface of the substrate 20 there is deposited a plurality (n) of alternating contiguous layers of high atomic number material $\mathbf{22}_1 \ldots \mathbf{22}_n$ and low atomic number material $\mathbf{24}_1 \ldots \mathbf{24}_n$. The thickness (t) of both the high atomic number and low atomic number material layers is substantially equal to an integral multiple of the wavelength being reflected therefrom, i.e. $t = m$ where m is an integer. The n number of layers is also a function of the wavelength of X-rays to be focused thereby.

Considering a typical example where the high atomic number of material for the layers $\mathbf{22}_1 \ldots \mathbf{24}_n$ comprises tungsten(W), while the low atomic number of material layers $\mathbf{24}_1 \ldots \mathbf{24}_n$ comprises carbon(C), layer thicknesses of 4.44 nm would be required for focusing X-rays emitted from a carbon sample having a wavelength of 4.44 nm. These layers can be fabricated by the well known technique of argon ion sputtering. For operation at the 4.44 nm wavelength, the maximum number of n layers of each material would be on the order of 1000 while the minimum number would be on the order of 50 layers each.

As shown in FIG. 4, the thickness of each layer may vary to compensate for the different paths taken by X-rays through the curved layers. An X-ray along axis 12 will enter and reflect from typical layer $\mathbf{22}_i$ along the same path; the axis. Accordingly, the thickness $t_1$ along the axis should be n/2, with n preferably equal to 1. However, a typical X-ray from sample 14 that is reflected to detector 16 enters layer $\mathbf{22}_i$ along path $d_i$ and reflects along path $d_o$, the angle between the paths being bisected by a line normal to the curve. Since the thickness $t_2$ is a function of $d_i + d_o$, the thickness at each point along the curve should be adjusted so that $d_i + d_o$ is m/2, with m as small as possible.

Such a construction may be accomplished by uneven plating of the layers of mirror 10, or by building mirror 10 from a plurality of small tiles arranged in concentric circles on a curved substrate, each circle having tiles plated with layers of a desired thickness for the portion of the mirror covered by the circle.

In a conventional electron column analytical instrument, where a detector with a 30 $mm^2$ detector area is located 30 mm from the sample to be analyzed, less than 0.3% of all generated x-rays are collected. However, if a spherical mirror, formed in accordance with the invention, and having a radius of 100 mm, is placed 150 mm from the sample, and assuming that the spherical mirror is only 50% efficient, the total collection efficiency will still be on the order of 100 times greater than that of a standard x-ray analytical instrument without a mirror. The specimen-to-mirror distance can be adjustable so long as the detector is moved in tandem with the mirror to preserve the focal length distance between the mirror and detector. When desirable, a rotary carousel type of structure including a plurality of non-planar mirrors could be used, with each mirror's reflection efficiency tuned to the X-ray wavelength of interest.

While the non-planar mirror is positioned as shown in FIG. 1 in accordance with the invention, another mirror of the same type may be positioned between the energy source and the sample. The additional mirror would most typically be used with micro-x-ray fluorescence analytical instruments. In x-ray fluorescence analysis, x-rays in a range of 0.05 nm and 0.2 nm are used to ionize the atoms of a sample, which then emits a characteristic spectrum of x-rays. FIG. 2 shows x-rays having a wavelength between 0.05 nm and 0.2 nm from a source 26 being directed to a non-planar mirror 10', in accordance with the invention. Mirror 10' is comprised of a non-planar substrate 20' on which multiple layers 22' and 24' of high atomic number material and low atomic number material, respectively, are fabricated. The relatively short wavelength x-rays from source 26 are collected by mirror element 10' and focussed onto sample 14', which is under test. Sample 14' fluoresces and emits X-rays having a wavelength greater that 1.5 nm. Then, as shown in the configuration of FIG. 1, emitted X-rays from sample 14' are collected by focusing mirror 10 and focused to a detector 16, located a focal length away from collecting mirror 10.

One of the major differences between electron column instruments and X-ray fluorescence instruments lies in the fact that the beam emitted from the X-ray source 26 in X-ray fluorescence instruments (FIG. 2) is usually a millimeter or more in diameter while the X-ray source size from the sample 14 in electron column instruments (FIG. 1) is sub-micron. In conventional X-ray fluorescence instruments, the X-ray beam size is reduced by collimation slits. The disadvantage of this technique is a great reduction in incident X-ray intensity; however, a focusing X-ray mirror as described with respect to FIG. 2, can be used to focus rather than collimate the beam to a small size. The only constraints recognized in fabricating a focusing X-ray mirror for X-ray fluorescence apparatus is the relatively shorter wavelength (0.05 nm–0.2 nm) of the X-rays reflected thereby requiring the layer of thicknesses 22' and 24' to be reduced accordingly. This is not believed, however, to provide much of an impediment inasmuch as present day technologies can lay down layers of only a few angstroms thick with techniques such as molecular beam epitaxy.

Having thus shown and described what is at present considered to be the preferred embodiment of the invention as well as its method of implementation and utilization, it should be noted that the same has been made by way of illustration and not limitation. Accordingly, all modifications, alterations and changes coming within the spirit and scope of the invention are herein meant to be included.

We claim:

1. An x-ray mirror for a chemical analytical instrument comprising:

a non-planar mirror for collecting and focusing x-rays, having a concave reflecting surface, and further including a base member and a plurality of contiguous non-planar alternating layers of selected high atomic number material and low atomic material, respectively, formed on said base, wherein the selection of said materials and the number of said layers is a function of the wavelength being focused, and wherein the thickness of each of said layers is substantially an integral multiple of the wavelength of x-rays being focused, and varies at each point along the curve of the layer according to a predetermined design for focusing.

2. The X-ray mirror as defined by claim 1 wherein the thickness of said layers focuses x-rays of wavelength greater than 1.5 nm.

3. The X-ray mirror as defined by claim 2 wherein the thickness of said layers focuses x-rays of wavelength in the range between 1.83nm and 6.7nm.

4. The X-ray mirror as defined by claim 1 wherein the thickness of said layers focuses x-rays of wavelength in the range of between 0.05nm and 0.2nm.

5. The x-ray mirror, as defined by claim 1, wherein said concave reflecting surface comprises a generally spherical surface.

6. The x-ray mirror, as defined by claim 1, wherein said concave reflecting surface comprises a generally cylindrical surface.

7. The x-ray mirror, as defined by claim 1, wherein said concave reflecting surface comprises a generally parabolic surface.

8. The x-ray mirror, as defined by claim 1, wherein said concave reflecting surface comprises a generally ellipsoidal surface.

9. A chemical analytical instrument for determining the material constituents of a sample, comprising:

(a) a predetermined energy source for directing energy upon said sample and causing the emission of x-rays from said sample, said x-ray energy having a wavelength spectrum characteristic of the material constituents of said sample;

(b) detecting means for receiving and detecting said x-rays emitted from said sample; and (c) a first non-planar energy reflecting means for collecting said x-rays emitted from said sample at a solid angle, for focusing said emitted x-rays, and for directing the collected and focused x-rays to said detecting means, said first reflecting means having a predetermined focal length and being interposed between said sample and said detecting means at a distance from said detecting means corresponding to said focal length.

10. The instrument as defined by claim 9, wherein said first non-planar reflecting means comprises a concave reflecting mirror formed of a base member and a plurality of contiguous non-planar alternating layers of selected high atomic number material and low atomic number material, respectively, covering said base member, wherein the selection of said materials and the number of said layers is a function of the wavelength of X-rays being focused, and wherein the thickness of each of said non-planar alternating layers is substantially an integral multiple of the wavelength of X-rays being focused, and varies at each point along the curve of the layer according to a predetermined design for focusing.

11. The instrument as defined by claim 9, wherein said non-planar reflecting means has a generally spherical, reflecting surface.

12. The instrument as defined by claim 10, wherein said high atomic number material comprises tungsten, said low atomic number material comprises carbon, and wherein the number of respective layers of said plurality of layers ranges between fifty and one thousand layers each.

13. The instrument as defined by claim 9, wherein said instrument is an electron column instrument.

14. The instrument as defined in claim 13, wherein said source of energy comprises a relatively high energy electron beam which causes said sample to ionize and emit x-rays having a wavelength spectrum greater than 1.5 nm.

15. The instrument as defined in claim 14, wherein said wavelength of said x-rays is in a range between 1.83 nm and 6.7 nm.

16. The instrument as defined by claim 9, wherein said instrument is a micro x-ray fluorescence instrument, and further comprising a second non-planar energy reflecting means for collecting said energy emitted from said source at a solid angle, for focusing said emitted energy, and for directing a beam of the focused energy at full incident intensity from said source to said sample, said second reflecting means having a predetermined focal length and being interposed between said energy source and said sample at a distance from said sample corresponding to said focal length.

17. The instrument as defined by claim 16, wherein said source of energy comprises a source of electromagnetic energy which causes said sample to fluoresce and emit x-rays having a wavelength spectrum less than 0.2 nm.

18. The instrument as defined by claim 17, wherein said source of energy comprises a source of x-rays having a wavelength between 0.05 nm and 0.2 nm.

19. The instrument as defined by claim 16, wherein said second non-planar reflecting means comprises a concave reflecting mirror formed of a base member and a plurality of contiguous non-planar alternating layers of selected high atomic number material and low atomic number material, respectively, covering said base member, wherein the selection of said materials and the number of said layers is a function of the wavelength of X-rays being focused, and wherein the thickness of each of said non-planar alternating layers is substantially an integral multiple of the wavelength of X-rays being focused, and varies at each point along the curve of the layer according to a predetermined design for focusing.

* * * * *